US006389752B1

(12) United States Patent
Rosenau

(10) Patent No.: US 6,389,752 B1
(45) **Date of Patent: *May 21, 2002**

(54) TOUCH SENSITIVE TRAPPING PROTECTOR FOR POWER OPERATED CLOSING DEVICES

(75) Inventor: Keith W. Rosenau, Ricchester Hills, MI (US)

(73) Assignee: Schlegel Corporation, New York, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/337,450

(22) Filed: Jun. 21, 1999

(51) Int. Cl.[7] ..... E05F 15/02
(52) U.S. Cl. ..... 49/28
(58) Field of Search ..... 49/26, 27, 28, 49/490.1, 475.1, 495.1; 200/61.43

(56) References Cited

U.S. PATENT DOCUMENTS

| | | | | | |
|---|---|---|---|---|---|
| 3,793,772 | A | * | 2/1974 | Kouth | 49/28 |
| 4,115,952 | A | * | 9/1978 | French | 49/26 |
| 4,351,016 | A | | 9/1982 | Felbinger | |
| 4,970,446 | A | | 11/1990 | Yaguchi | |
| 5,166,482 | A | | 11/1992 | Li | |
| 5,384,982 | A | * | 1/1995 | Galperin | 49/27 |
| 5,459,962 | A | * | 10/1995 | Bonne et al. | 49/28 |
| 5,592,060 | A | * | 1/1997 | Racine et al. | 49/27 X |
| 5,663,633 | A | * | 9/1997 | Kahn et al. | 323/218 |
| 5,834,719 | A | * | 11/1998 | Kaji et al. | 49/28 X |
| 5,880,421 | A | * | 3/1999 | Tsuge et al. | 49/28 X |
| 5,933,671 | A | | 8/1999 | Stephany et al. | |

FOREIGN PATENT DOCUMENTS

DE 37 24 942 A 2/1989

* cited by examiner

*Primary Examiner*—Jerry Redman
(74) *Attorney, Agent, or Firm*—Brian B. Shaw, Esq.; Stephen B. Salai, Esq.; Harter, Secrest & Emery LLP

(57) ABSTRACT

A trapping protector for a power operated closing device includes a profile strip of elastomer material formed as an extruded member including a touch sensitive profile having a conductive surface portion extending substantially along the length of the profile in the area facing a leading edge of a movable panel in conjunction with which the trapping protector is used, and a touch sensitive detector coupled to the conductive surface for generating a triggering signal when the conductive surface portion is touched, without requiring any significant displacement of the surface portion. Preferably, but not necessarily, the profile strip also includes a sealing profile connected to the touch sensitive profile for sealing the closing device. The sealing profile can be a separately extruded strip if desired. In accordance with another aspect of the invention, the conductive surface portion comprises a layer of conductive elastomer and an electrical conductor in ohmic contact with the elastomer.

18 Claims, 1 Drawing Sheet

TOUCH SENSITIVE TRAPPING PROTECTOR FOR POWER OPERATED CLOSING DEVICES

BACKGROUND OF THE INVENTION

This invention relates generally to a trapping protector for power operated closing devices, especially electrically operated windows and sun roofs for motor vehicles, and more particularly to a two-mode trapping protector responsive to both the pressure created when an object is trapped by a power operated closing device, and also touch sensitive to stop the power operated closing device from operating even before an object is trapped by the window or sun roof.

Trapping protectors that are responsive to the pressure created when an object is trapped by a closing panel, such as a window or sun roof in a motor vehicle, are described for example in U.S. Pat. No. 5,459,962. In that trapping protector, power operated closing devices, particularly electrically operated windows and sun roofs of motor vehicles, have two electrical connectors spaced apart from each other for disengaging the switching process of a drive unit when brought into contact by an object in the path of the window or sun roof. For the purposes of simple manufacture and reliable contact making, the known trapping protector is provided with a flexible hollow profile made of an elastomer or plastic material, having a flat base area and mounted arched profile area enclosing a hollow chamber. The base area and zenith area of the arched profile area include conductive material and are separated from each other by insulating profile areas. When pressure is exerted on any point along the profile, a switching process for reversing or stopping a drive unit is triggered by the resultant resistance reduction and current increase when the conductive areas touch.

Although the known trapping protector is effective, it does require that slight pressure is exerted on the trapped objects, such as the fingers of an occupant, before the trapping protector generates a triggering signal to reverse or stop the operation of the closing motor. Although serious injury is prevented, very young children may be frightened by even the slight pressure required to operate the trapping protector.

It is an object of this invention to provide an improved trapping protector that triggers a switching process for reversing or stopping the drive unit in either of two situations. First, the improved trapping protector of this invention includes the two mutually spaced apart electrical conductors of the known trapping protector, or a pressure sensitive detector so that pressure created by a trapped object triggers the switching process. In addition, the trapping protector of this invention includes a touch responsive sensor so that it is not necessary for any pressure to be exerted before the switching process for reversing or stopping a drive unit is triggered.

It is an object of this invention to provide a touch sensitive detector for providing trapping protection for power operated closing devices, such as windows or sun roofs of motor vehicles that does not require pressure to initiate a switching process for reversing or stopping a drive unit.

It is another object of this invention to provide such a touch sensitive trapping protector that is compatible with pressure sensitive trapping protectors heretofore known, so that a dual mode trapping protector can be implemented.

Briefly stated, and in accordance with a presently preferred embodiment of the invention, a trapping protector for a power operated closing device includes a sealing profile of elastomer material preferably formed as an extruded or molded member and including a touch sensitive portion having a conductive surface extending substantially along the length of the profile in the area facing a leading edge of a movable panel in conjunction with which the trapping protector is used, and a touch sensitive detector coupled to the conductive surface for generating a triggering signal when the conductive surface is touched, without requiring any significant displacement of the touch sensitive portion. Preferably, but not necessarily, the sealing profile also includes a sealing element such as a bulb or fin profile connected to the profile for sealing the closing device. The sealing element can be a separately extruded or molded strip if desired.

In accordance with another aspect of the invention, the conductive surface comprises a layer of conductive elastomer and an electrical conductor in ohmic contact with the elastomer.

In accordance with another aspect of the invention, the electrical conductor is embedded in the elastomer.

In accordance with still another aspect of the invention, the touch sensitive detector is connected to the electrical conductor.

In accordance with another embodiment of the invention, dual mode trapping protector for a power operated closing device includes a sealing profile of elastomeric material, formed as an extruded member, and including the sealing element for sealing the closing device, and a trapping protector in the form of a hollow element that is connected with or separate from the sealing profile, the hollow element having a first conductive surface portion extending substantially along the length of the hollow element in the area facing the leading edge of a movable panel in conjunction with which the trapping projector is used, and a second conductive surface portion spaced apart from the first conductive surface portion, and movable towards and into electrical contact therewith, when an object is trapped, a touch sensitive detector coupled to the first conductive surface portion for generating a triggering signal when the conductive surface portion is touched, without requiring any significant displacement of the first surface portion, and a second detector connected to the first and second conductive surface portions for generating a triggering signal when the first and second conductive surface portions on the hollow profile are moved into electrical contact or otherwise compressed by a trapped object.

In accordance with another aspect of the invention, the first conductive surface portion comprises a layer of conductive elastomer, and an electrical conductor in ohmic contact with the elastomer.

In accordance with another aspect of the invention, the second detector is connected to the electrical conductor.

BRIEF DESCRIPTION OF THE DRAWINGS

While the novel aspects of the invention are set forth with particularity in the appended claims, the invention itself, together with further objects and advantages thereof may be more readily understood by reference to the following detailed description of a presently preferred embodiment of the invention, taken in conjunction with the accompanying drawings, in which:

DETAILED DESCRIPTION OF A PREFERRED EMBODIMENT

Figure 1:
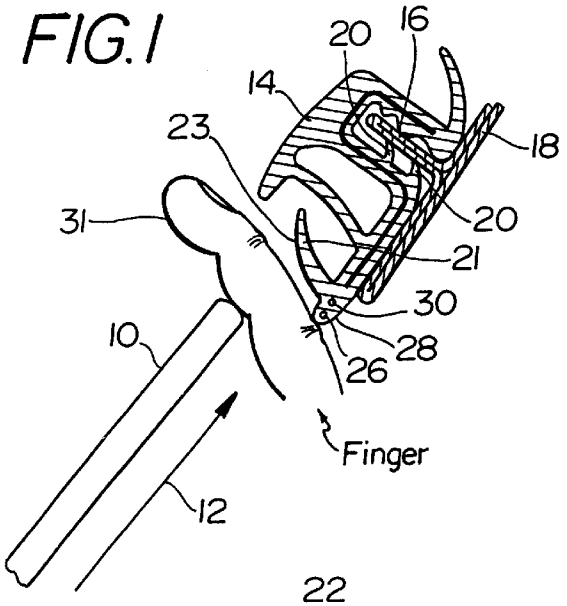
FIG. 1 is a side view, partly in section, of an anti-finger trap system in accordance with this invention.

Referring now to FIG. 1, the area adjacent the upper edge of a vehicle window is illustrated in a diagrammatic, partly sectioned view. Window pane 10 moves in the direction of arrow 12 into engagement with a weatherseal assembly 14. The anti-finger trap mechanism of this invention is integrated with sealing profile 14. The weatherseal is mounted on a flange 16 of the body or door portion 18 adjacent the upper edge of the glass panel 10 when closed. The sealing profile 14 preferably includes a conventional U-shaped attaching portion having a plurality of sealing lips 20 formed on an inner surface of one leg of the attaching portion for firmly gripping flange 16. The sealing profile includes a sealing lip 21 preferably having a low friction coating layer 23 thereon, for forming a seal with the upper edge of the glass panel, as is conventional.

Figure 2:
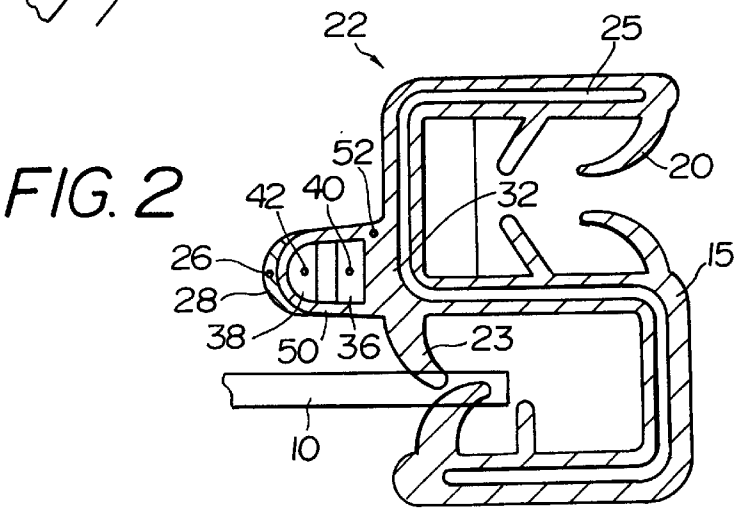
FIG. 2 is a section view of another embodiment of an anti-finger trap system of the invention.

Depending on the configuration of the member to which the sealing profile is mounted, the attaching portion may take a different form as shown in FIG. 2. Glass run sealing profile 15 also includes a U-shaped mounting portion 22, which is preferably reinforced with a wire or stamped metal carrier 25, as is well known to those skilled in the art. Preferably, the sealing profile 15 is made from non-conductive material, such as thermosetting elastomers or thermoplastic elastomers.

Referring back to FIG. 1, a conductive elastomeric layer 28 is formed at the distal end of one leg of the window receiving portion of the sealing profile assembly. Preferably, the conductive elastomeric layer includes an embedded electrical conductor 26 in low resistance contact with the conductive elastomeric material, and for attachment to a sensor, as will be described in more detail below. The conductive elastomeric portion is arranged so that in the event that a finger 31 is interposed between the leading edge of a closing window panel 10, the finger will be brought into contact with conductive layer 27 before it can be forcibly trapped by the moving window panel.

Optionally, a second conductor 30 is embedded in a non-conductive portion of the distal end of a leg of the window receiving portion of the weatherseal assembly, for conveniently completing an electrical circuit.

Referring now to FIG. 2, a dual mode trapping protector in accordance with the invention is shown. The base of the preferably U-shaped attaching portion 22 has a dual mode trapping protector attached thereto. The trapping protector is provided with a bead of conductive rubber 28 extending along an outer surface thereof. An electrical conductor 26 is preferably embedded in the conductive layer 28. Preferably, the weatherseal is extruded, and the conductive rubber bead may be co-extruded therewith. Elastomers, thermoplastic elastomers, or thermoplastics can be used for the touch sensitive portion, and the conductivity of such materials can be increased by adding conductive materials such as carbon blacks, graphite or metal powder to a base material. The combination of the electrical conductor or wire 26 with the conductive rubber bead 28 forms an elongated conductive surface portion extending substantially along the length of the sealing profile in the area facing the leading edge of window pane 10. While the electrical conductor is shown as embedded in the elongated conductor surface portion, it may be disposed between the non-conductive and conductive portions, as long as it is in electrical contact with the conductive portion.

Optionally, a second electrical conductor 52 (see FIG. 2) is provided in a non-conducting portion 32 of the weatherseal. Conductor 52 may be conveniently employed to form a complete electrical circuit, depending on the type of sensor employed.

Figure 3:
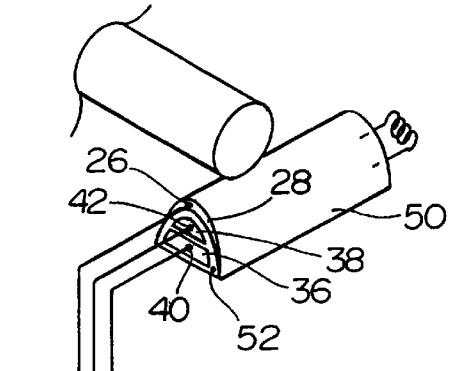
FIG. 3 is a view, partly in section, of a dual mode sensor for a finger-trap in accordance with this invention.

FIG. 3 is diagrammatic inasmuch as it only shows the anti-finger trapping portion of the sealing profile in accordance with the invention. The placement of a sealing profile of the type with which this invention is concerned that incorporates the dual mode anti-finger trapping embodiment of the invention is shown in more detail at FIGS. 1 and 2.

For now, referring to FIG. 3, a pressure sensitive detector is implemented by conductive regions 36 and 38, each of which includes an embedded or contacting electrical conductor 40 and 42 respectively. The conductor regions are encased within a hollow flexible tubular portion 50 of the weatherstrip, which has flexible side walls that upon the application of pressure the conductive regions 36 and 38 are brought into contact with each other, which contact can be sensed remotely as a drop in resistance of the circuit formed by electrical conductors 40 and 42. The touch sensitive conductive layer 28 is formed on the surface of the hollow tubular member 50 and has its own electrically conductive wire embedded therein or at least in electrical contact therewith. If desired, yet another electrical wire 52 can be provided in non-conducting tubing member 50 for forming a complete circuit with wire 26.

The dual mode anti-finger tip protector of FIG. 3 has a significant advantage over the single mode protector. If an object is interposed between the leading edge of the glass panel and the protector that does not trigger the touch sensitive mode of the detector, as might occur if an occupant were wearing gloves, the window will not stop closing until some pressure is exerted on the detector and conductive regions 36 and 38 come into contact, at which time a trigger signal is generated and the window either stops closing or opens. Without the touch sensitive detector portion of the dual mode detector of this invention, some pressure must be exerted on an object before a trigger signal is generated, and this can be frightening to small children.

As shown in FIG. 3, the sensing portion 50 of the anti-finger trap detector is connected to a detector circuit 60. A portion of detector circuit 60 that is responsive to pressure induced contact being formed between conductive regions 36 and 38 is well known, and will not be described further. The portion of detector 60 that is responsive to touch sensitive region 28 may take a variety of forms. Touch sensors for operating table lamps and the like are well known, and sensors of similar design can be employed in connection with this invention. Since only low voltage power is usually available in vehicles, the touch sensitive detector may be implemented by connecting the electrical wire running through the touch sensitive layer of the device to the gate of a field effect transistor or the like, so that the transistor will be turned on when the layer is touched. Appropriate latching circuitry or the like, as will be apparent to those skilled in the art, can be employed in connection with the other elements of this invention.

Figure 4:
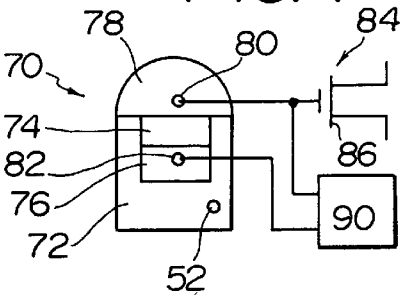
FIG. 4 is a section of a dual mode sensor in accordance with another embodiment of the invention.

Referring now to FIG. 4, a dual mode trapping protector in accordance with another embodiment of the invention is illustrated in diagrammatic cross section form. The trapping protector indicated generally at 70 includes a non-conductive resilient body formed from thermoplastic or thermosetting material. A channel 74 is formed in the non-conductive body and a layer of conductive material such as a conductive rubber foam is disposed in a bottom portion of the channel. A touch sensitive cap 78 is attached to the upper side walls of the channel. A first electrical conductor 80 is embedded in touch sensitive cap 78 and a second electrical conductor 82 is embedded in layer 76. Electrical conductor 80 is connected to a touch sensitive detector 84 designated in this example by a connection to the gate of FET 86. A pressure sensitive detector 90, preferably a detector for responding to a contact closure is connected to electrodes 80 and 82. In operation, the dual mode detector of FIG. 4 is responsive to contact with conductive layer 78 by triggering FET 86 to produce a switching signal. Dual mode trapping protector 70 is responsive to pressure sufficient to cause the side walls of the channel formed in the base 72 of the trapping protector to flex and the conductive layers 78 and 76 to be brought into contact, to trigger detector 90 also to generate a switching signal. This configuration eliminates one of the elements of the earlier configuration at a slight increase in circuit complexity and may be desirable in some circumstances.

Figure 5:
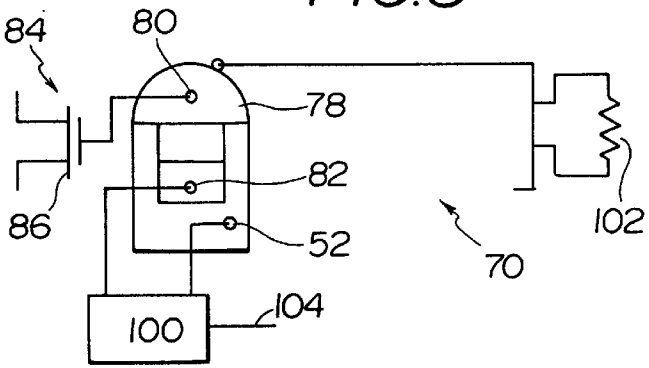
FIG. 5 is a diagrammatic view of a dual mode system that includes a sensor integrity checker in accordance with the invention.

Referring now to FIG. 5, a detector integrity checker in accordance with this invention is included in diagrammatic form. While the integrity checker shown in FIG. 5 is illustrated in combination with the embodiment of the invention shown in FIG. 4, it may also be employed in connection with the embodiments as shown in any of the other figures.

Profile 70, shown in a straight section but understood to conform to the outline of a window or other opening, is substantially the same as the profile shown in FIG. 4. A touch sensitive detector 84 including an FET 86 is connected to conductor 80, which is embedded in conductive surface portion 78 of the profile. Conductor 80 is attached to the gate of field effect transistor 86, which it will be understood is merely representative of a touch sensitive detector.

Conductors 82 and 52 are connected to a controller 100 which will be understood to provide the functions of detector 90 and an additional integrity checking function. A resistor 102 is connected between conductors 82 and 52, at a remote end of the profile 70. The resistor provides constant impedance and is preferably attached to the ends of the conductor and secured in place by an end molding or the like.

Controller 100 verifies the integrity of the dual mode trapping protector system by, for example, generating a short pulse that is coupled to conductors 82 and 62, and which travels along profile 70 to the end, whereupon, if the profile is intact, it is reflected from resistor 102 and returned to controller 100, whereupon, after being detected, the controller recognizes that the profile is intact. If the profile is damaged, for example by cutting, crushing or the like, the reflected pulse will arrive either too early, or too late, or not at all, and the controller 100 generates a fault signal at output 104, which can be used for example to disable an auto up feature of a power window, light a false indicator, or otherwise respond appropriately to an inoperative anti finger trap system.

While the invention has been described in connection with a presently preferred embodiment thereof, those skilled in the art will recognize that many modifications and changes may be made therein without departing from the true spirit and scope of the invention, which accordingly is intended to be defined solely by the appended claims.

What is claimed is:

1. In a power operated closing device, a trapping protector comprising:

a sealing profile of elastomeric material, said profile including a sealing element for sealing the closing device, and a trapping protector in the form of a touch sensitive profile connected with said sealing profile;

the touch sensitive profile having a conductive surface portion extending substantially along the length of the profile in the area facing the leading edge of a movable panel in conjunction with the trapping protector is used;

a touch sensitive detector coupled to the conductive surface portion, generating a triggering signal when the conductive surface portion is touched, without requiring any displacement of the surface portion; and a terminator connected to a distal end of the touch sensitive profile and a detector connected to a proximal end of the touch sensitive profile for sending a signal to the terminator, receiving a responsive signal and generating a fault signal if the responsive signal indicates a loss of integrity in the profile.

2. The trapping protector of claim 1 in which the conductive surface portion comprises a layer of conductive elastomer, and an electrical conductor in ohmic contact with the elastomer.

3. The trapping protector of claim 2 in which the touch sensitive detector is connected to the electrical conductor.

4. The trapping protector of claim 1, in which the terminator is a resistor.

5. In a power operated closing device, a dual mode trapping protector assembly comprising:

a sealing profile of elastomeric material, said profile including a trapping protector in the form of a hollow element;

the hollow element having a first conductive surface portion extending substantially along the length of the sealing profile in the area facing the leading edge of a movable panel in conjunction with the trapping protector is used;

the hollow profile having a second conductive surface portion, spaced apart from the first conductive surface portion and movable towards and into electrical contact therewith when an object is trapped;

a touch sensitive detector coupled to the second conductive surface portion, generating a triggering signal when the second conductive surface portion is touched, without requiring any displacement of the second conductive surface portion;

and a compression detector connected to the first and second conductive surface portions for generating a triggering signal when the first and second conductive surface portions on the hollow profile are moved into electrical contact by a trapped object.

6. The trapping protector of claim 5 in which the first conductive surface portion comprises a layer of conductive elastomer, and an electrical conductor in ohmic contact with the elastomer.

7. The trapping protector of claim 6 in which the detector is connected to the electrical conductor.

8. The trapping protector of claim 5 comprising a terminator connected to a distal end of the second conductive surface portion and a detector connected to a proximal end of the second conductive surface portion for sending a signal to the terminator, receiving a responsive signal and generating a fault signal if the responsive signal indicates a loss of integrity in the profile.

9. The trapping protector of claim 8, in which the terminator is a resistor.

10. In a power operated closing device, a trapping protector assembly comprising:

a sealing profile of elastomeric material, said profile including a trapping protector in the form of a touch sensitive profile connected with said sealing profile;

the touch sensitive profile having a conductive surface portion extending substantially along the length of the sealing profile in the area facing the leading edge of a movable panel in conjunction with the trapping protector is used;

a touch sensitive detector coupled to the conductive surface portion, generating a triggering signal when the conductive surface portion is touched, without requiring any displacement of the surface portion; and a terminator connected to a distal end of the conductive surface portion and a detector connected to a proximal end of the conductive surface portion for sending a signal to the terminator, receiving a responsive signal and generating a fault signal if the responsive signal indicates a loss of integrity in the profile.

11. The trapping protector of claim 10 in which the conductive surface portion comprises a layer of conductive elastomer, and an electrical conductor in ohmic contact with the elastomer.

12. The trapping projector of claim 11 in which the touch sensitive detector is connected to the electrical conductor.

13. The trapping protector of claim 10, in which the terminator is a resistor.

14. In a power operated closing device, a dual mode trapping protector assembly comprising:

a sealing profile of elastomeric material, and including a sealing element for sealing the closing device, and a trapping protector in the form of a hollow element connected with the sealing profile, the trapping protector including a conductive surface portion;

a touch sensitive detector coupled to the conductive surface portion, generating a triggering signal when the conductive surface portion is touched, without requiring any displacement of the surface portion;

and a pressure detector connected to the hollow element for generating a triggering signal when the hollow element is compressed by a trapped object.

15. The trapping protector of claim 14 in which the conductive surface portion comprises a layer of conductive elastomer, and an electrical conductor in ohmic contact with the elastomer.

16. The trapping protector of claim 15 in which the touch sensitive detector is connected to the electrical conductor.

17. The trapping protector of claim 14 comprising a terminator connected to a distal end of the second conductive surface portion and a detector connected to a proximal end of the second conductive surface for sending a signal to the terminator, receiving a responsive signal and generating a fault signal if the responsive signal indicates a loss of integrity in the profile.

18. The trapping protector of claim 17, in which the terminator is a resistor.

* * * * *

UNITED STATES PATENT AND TRADEMARK OFFICE

CERTIFICATE OF CORRECTION

PATENT NO. : 6,389,752 B1
DATED : May 21, 2002
INVENTOR(S) : Keith W. Rosenau

It is certified that error appears in the above-identified patent and that said Letters Patent is hereby corrected as shown below:

Title page,
Item [75], should read -- [75] Inventor: Keith W. Rosenau, Rochester Hills, MI (US) --

Signed and Sealed this

Twenty-third Day of July, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,389,752 B1
DATED : May 21, 2002
INVENTOR(S) : Rosenau, Keith W.

It is certified that error appears in the above-identified patent and that said Letters Patent is hereby corrected as shown below:

Column 3,
Line 44, reference number "27" should read -- 28 --.

Signed and Sealed this

Seventh Day of October, 2003

JAMES E. ROGAN
*Director of the United States Patent and Trademark Office*